US010017136B1

(12) United States Patent
Waisanen et al.

(10) Patent No.: US 10,017,136 B1
(45) Date of Patent: Jul. 10, 2018

(54) OUTBOARD MOTOR AND RIGGING SYSTEM FOR OUTBOARD MOTOR

(71) Applicant: Brunswick Corporation, Lake Forest, IL (US)

(72) Inventors: Andrew S. Waisanen, Fond du Lac, WI (US); Jeffrey C. Etapa, Oakfield, WI (US); Steven J. Gonring, Slinger, WI (US)

(73) Assignee: Brunswick Corporation, Mettawa, IL (US)

( * ) Notice: Subject to any disclaimer, the term of this patent is extended or adjusted under 35 U.S.C. 154(b) by 218 days.

(21) Appl. No.: 14/969,656

(22) Filed: Dec. 15, 2015

(51) Int. Cl.
*B63H 20/32* (2006.01)
*B60R 16/03* (2006.01)
*B63H 20/02* (2006.01)

(52) U.S. Cl.
CPC ..... *B60R 16/03* (2013.01); *B63H 20/02* (2013.01); *B63H 20/32* (2013.01)

(58) Field of Classification Search
CPC ..... B63H 20/02; B63H 20/32; B60R 16/03
See application file for complete search history.

(56) References Cited

U.S. PATENT DOCUMENTS 3,950,059 A 4/1976 Anhalt et al.
4,933,809 A 6/1990 Boede et al.
4,969,847 A * 11/1990 Curtis ..... B63H 20/001 123/195 P
5,007,858 A 4/1991 Daly et al.
6,183,322 B1 2/2001 Takahashi
6,257,940 B1 7/2001 Dunham et al.
6,273,771 B1 8/2001 Buckley et al.
6,960,108 B1 11/2005 Jaszewski et al.
7,104,856 B1 9/2006 Krupp et al.
7,144,283 B2 12/2006 Kawase
7,704,109 B2 4/2010 Arai et al.
8,118,629 B2 * 2/2012 Gallato ..... B63H 5/125 440/61 T
8,858,280 B1 10/2014 Wiegele et al.

* cited by examiner

*Primary Examiner* — Stephen P Avila
(74) *Attorney, Agent, or Firm* — Andrus Intellectual Property Law, LLP

(57) ABSTRACT

An outboard motor can be coupled to a transom of a marine vessel via the described rigging system. The rigging system includes a plurality of engine-sourced lines extending from an engine of the outboard motor, through an aperture in the motor housing, and to the marine vessel. A protective tube surrounds the plurality of engine-sourced lines and has a first end coupled to the motor housing and a second end coupled to the marine vessel. A rigging center is located aboard the marine vessel and holds distal ends of each of the engine-sourced lines. A plurality of connectors is provided on the distal ends of the engine-sourced lines. At the rigging center, each engine-sourced line is configured to be coupled, via a respective connector, to a corresponding vessel-sourced line. The vessel-sourced lines are in turn connected to respective engine-related devices aboard the marine vessel.

16 Claims, 5 Drawing Sheets

OUTBOARD MOTOR AND RIGGING SYSTEM FOR OUTBOARD MOTOR

FIELD

The present disclosure relates to outboard motors and to rigging systems for coupling outboard motors to a transom of a marine vessel.

BACKGROUND

The following U.S. patents and publications are hereby incorporated by reference herein.

U.S. Pat. No. 4,933,809 discloses a modular assembly of diverse electrical components for operation of an outboard motor, including a box in which the components are inserted and/or mounted and prewired. External leads are organized for passage through a few specially located openings in the box for external connection. The fully assembled and prewired assembly is enclosed with a demountable cover and attached directly to the engine block. The modular assembly alleviates indiscriminate component mounting and corresponding disarray of interconnecting lead wires. In addition, the moisture and corrosion resistance of the components is enhanced.

U.S. Pat. No. 4,969,847 discloses a strain relief assembly for an outboard motor for relieving strain on wires, cables, lines or the like that extend between the boat and the cowl assembly, which encloses the power head of the outboard motor. The strain relief assembly is preferably disposed within an opening formed in one of the cowl sections, and comprises a two-piece member. The two-piece member includes a series of indentations which cooperate to clamp the wires, cables, lines or the like therebetween when screwed together. With the strain relief assembly fixed to the wall of the cowl section forming the opening, this acts to maintain the wires, cables or lines in position relative to the cowl section for relieving strain thereon during movement of the outboard motor. A fuel line strain relief assembly is also provided, comprising a stem fixed to the two-piece member. An external fuel line supplies fuel to the stem, which is communicated therethrough to an internal fuel line extending between the stem and the power head.

U.S. Pat. No. 6,273,771 discloses a control system for a marine vessel incorporating a marine propulsion system that can be attached to a marine vessel and connected in signal communication with a serial communication bus and a controller. A plurality of input devices and output devices are also connected in signal communication with the communication bus and a bus access manager, such as a CAN Kingdom network, is connected in signal communication with the controller to regulate the incorporation of additional devices to the plurality of devices in signal communication with the bus whereby the controller is connected in signal communication with each of the plurality of devices on the communication bus. The input and output devices can each transmit messages to the serial communication bus for receipt by other devices.

U.S. Pat. No. 6,960,108 discloses a protective containment device that serves as a strain relief component for hoses, wires, and push-pull cables extending through a front surface of an outboard motor. The protective containment device is formed from first and second portions that are assembled together with a flexibly connected divider that segregates certain components within the protective device from other components. A cylindrical ring, made of first and second retainers, is disposed around an outer surface of the cylindrical conduit to hold the first and second portions together and to retain a flexible tube in place.

U.S. Pat. No. 7,104,856 discloses a rigging apparatus for an outboard motor in which an attachment member is shaped to be rigidly attached to a housing structure, or cowl, of an outboard motor, without the need for additional hardware such as clamps, brackets, or screws. The attachment member is shaped to receive a threaded sleeve in threaded association therewith so that hoses, wires, and cables can be protected within the threaded sleeve. An attachment member of the rigging apparatus is made to be asymmetrical to avoid improper assembly into an opening of the housing structure of an outboard motor.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

According to one example of the present disclosure, a rigging system is designed for coupling an outboard motor to a transom of a marine vessel. The rigging system includes a plurality of engine-sourced lines extending from an engine of the outboard motor, through an aperture in a motor housing, and to the marine vessel. A protective tube surrounds the plurality of engine-sourced lines and has a first end coupled to the motor housing and a second end coupled to the marine vessel. A rigging center is configured to be located aboard the marine vessel. The rigging center holds a respective distal end of each engine-sourced line in the plurality of engine-sourced lines. A plurality of connectors is provided on the respective distal ends of the plurality of engine-sourced lines. At the rigging center, each engine-sourced line in the plurality of engine-sourced lines is configured to be coupled, via a respective connector in the plurality of connectors, to a corresponding vessel-sourced line. The vessel-sourced line is in turn connected to a respective engine-related device aboard the marine vessel.

According to another example of the present disclosure, an outboard motor is designed for coupling to a transom of a marine vessel. The outboard motor includes an engine coupled in torque-transmitting relationship with a propulsor via a drive shaft. A cowl houses the engine therein. An opening extends through a surface of the cowl, and a plurality of engine-sourced lines having proximate ends connected to the engine exit the cowl via the opening. An ingress adapter covers the opening and provides a watertight seal between the surface of the cowl and the plurality of engine-sourced lines. The plurality of engine-sourced lines is configured to extend continuously to the marine vessel and there to terminate at a plurality of distal ends. Aboard the marine vessel, each distal end in the plurality of distal ends of the engine-sourced lines is configured to couple to a respective vessel-sourced line that is in turn connected to a respective engine-related device aboard the marine vessel.

BRIEF DESCRIPTION OF THE DRAWINGS

The present disclosure is described with reference to the following Figures. The same numbers are used throughout the Figures to reference like features and like components.

DETAILED DESCRIPTION

In the present description, certain terms have been used for brevity, clarity and understanding. No unnecessary limitations are to be inferred therefrom beyond the requirement of the prior art because such terms are used for descriptive purposes only and are intended to be broadly construed.

Figure 1:
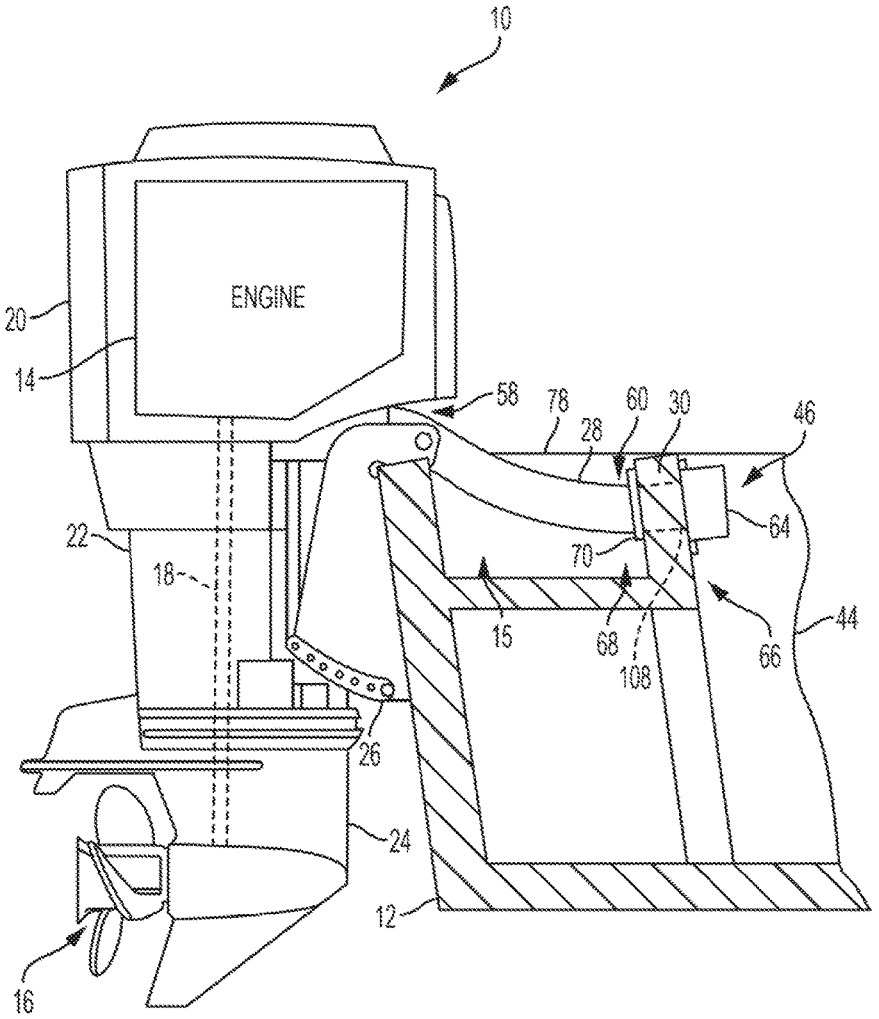
FIG. 1 illustrates a side view of an outboard motor coupled to a transom of a marine vessel.

FIG. 1 illustrates an outboard motor 10 for coupling to a transom 12 of a marine vessel 44. The outboard motor 10 includes an engine 14 coupled in torque-transmitting relationship with a propulsor 16 via a drive shaft 18 and a number of gears, as known to those having ordinary skill in the art. The outboard motor 10 also includes a housing or cowl 20 that houses the engine 14 therein. The engine 14 could be any type of engine, and specifics of the engine are not limiting on the scope of the present disclosure. Similarly, the propulsor 16, although shown herein as a single propeller, could be any type of propulsor such as a dual counter-rotating propeller, a jet drive, an impeller, etc., and is not limiting on the scope of the present disclosure. The outboard motor 10 includes the above-mentioned cowl 20, as well as a drive shaft housing 22 and a gear case 24, although other configurations for protective housings over the engine 14 and related outboard motor components could be provided.

The outboard motor 10 is coupled to the transom 12 of the marine vessel 44 by way of a transom bracket 26. The transom bracket 26 shown here is relatively standard, and it should be noted that other configurations and/or types of transom brackets or outboard motor mounting systems could be used. By way of actuators provided on the transom 12 or on the transom bracket 26, the outboard motor 10 can be steered, tilted, trimmed, and moved in various ways in order to provide different directions of propulsive force to propel the marine vessel 44 in different directions. Commands to move the outboard motor 10 in such a manner can be provided by various outboard motor-related and/or engine-related devices aboard the marine vessel 44. For example, steering and trim commands can be input by an operator at the helm 50 of the marine vessel 44 shown in FIG. 6, which will be described in further detail below.

Figure 6:
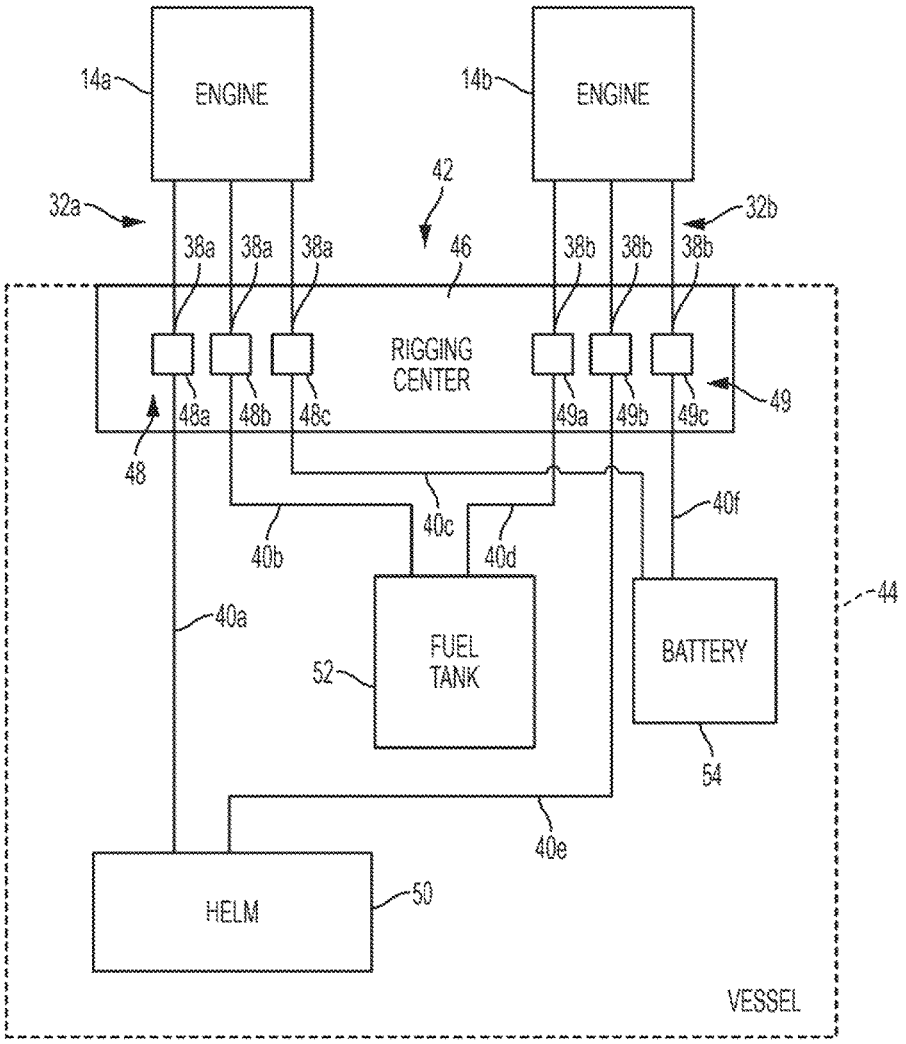
FIG. 6 is a schematic illustrating two outboard motors in communication with a number of engine-related devices aboard a marine vessel.

Referring to both FIGS. 1 and 6, typically, various hoses, wires, cables, or the like extend between a marine vessel 44 and an outboard motor 10 coupled to the vessel's transom 12 and terminate in the interior of the cowl 20. For example, the electrical system for an internal combustion engine-driven outboard motor includes a wide variety of diverse electrical control components. An engine harness 15 may extend between the powerhead and a steering remote control, which is mounted at the vessel's helm 50. The harness 15 may contain electrical lines that relay digital throttle and shift commands (or push-pull cables that relay manual throttle and shift commands) between the helm 50 and the powerhead as well. Electrical lines relaying other types of control signals may also be present. Additionally, in most applications, positive and negative battery cables run between a battery 54 housed within the vessel 44 and terminals provided on the powerhead. Moreover, a fuel line supplies fuel to the powerhead from a fuel tank 52 housed within the vessel 44.

For reasons of convenience, most of the above-mentioned electrical control components are preferably mounted on or closely adjacent the engine 14. Operating power for the electrical system and for charging the battery 54 is generated by an alternator or stator incorporated into the engine flywheel, and other components utilized in the direct control of engine operation—such as a voltage regulator and a spark ignition system—are most conveniently located in close proximity to the alternator and the engine 14. The fuel line also connects to the engine 14 to provide fuel for combustion.

Many of the electrical control components are subject to high corrosion and/or their performance is adversely affected if they get wet. Obviously, the environment in which an outboard motor 10 is operated is highly conducive to corrosion and moisture problems. Although the engine housing or cowl 20 provides some protection, most engine-mounted electrical components are still subject to corrosive attack as well as the possibility of becoming damp or wet. Further, during movement of the outboard motor 10, such as steering or tilting, the above-described wires and cables often experience strain resulting from contact between the wires and cables and the wall of an opening in the cowl 20 through which the wires and cables extend. Such strain is detrimental, and may ultimately result in failure of the wires and cables upon continued such movement of the outboard motor 10.

FIG. 1 shows a protective tube 28 that covers the various cables, wires, and the like to prevent water intrusion and/or other interference as they extend from the outboard motor 10 to the marine vessel 44. The protective tube 28 surrounds this plurality of engine-sourced lines 32 (including the above-described cables, wires, and hoses) and has a first end 58 coupled to the motor housing (cowl) 20 and a second end 60 coupled to the marine vessel 44. Note that in FIG. 1 the protective tube 28 (and thus the plurality of engine-sourced lines 32 lines) extends from the outboard motor 10 to a false transom 30 provided just fore of the true transom 12. Note that in other vessel arrangements, the engine-sourced lines 32 may extend to enter the vessel 44 at the true transom 12, or at another location aboard the vessel 44. For ease of description, both the transom 12 and the false transom 30 will herein after be referred to as the "transom."

Figure 2:
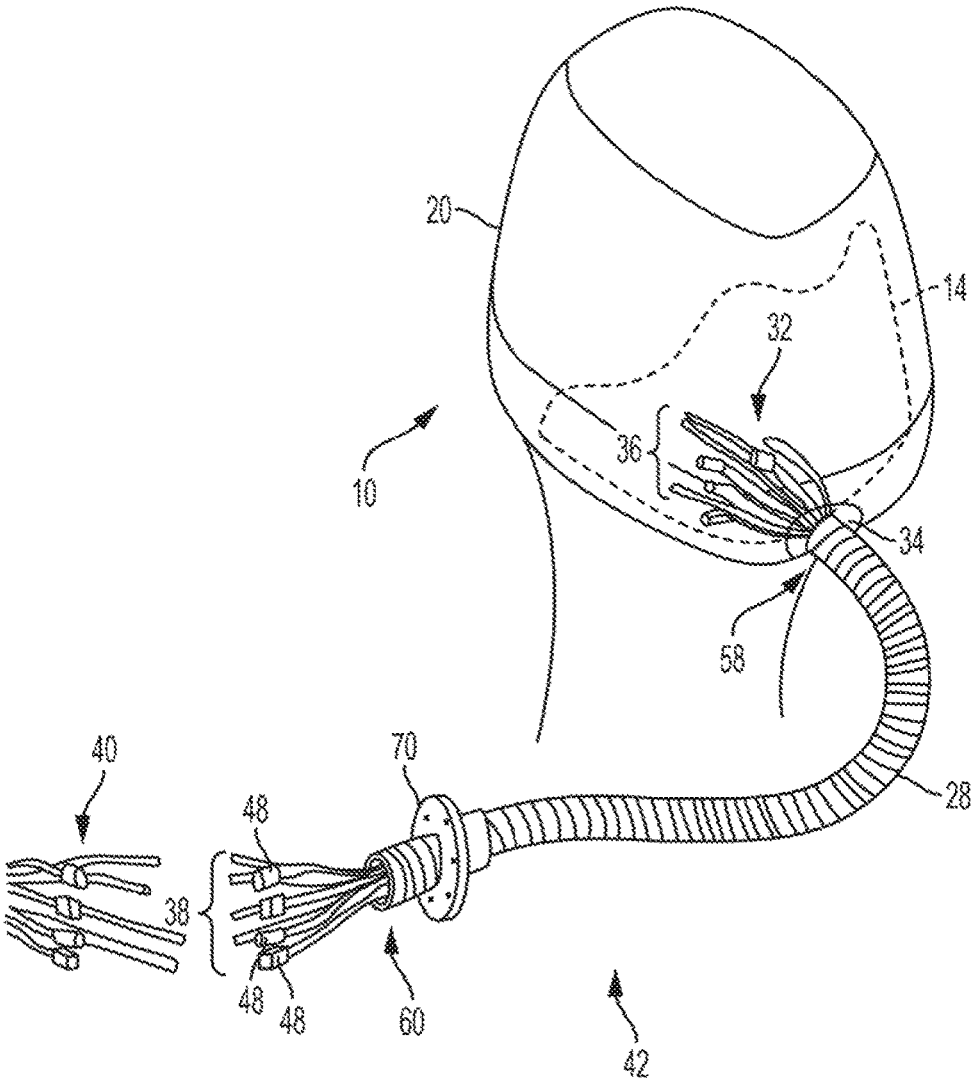
FIG. 2 illustrates a portion of the outboard motor, decoupled from the transom, and a portion of rigging system provided with the outboard motor.

Now turning to FIG. 2, it can be seen that in order to allow for the plurality of engine-sourced lines 32 that have proximate ends 36 connected to the engine 14 to exit the cowl 20, an opening 34 is provided in the surface of the cowl 20. Typically, at this opening 34, adapters and/or grommets are provided in order to prevent water intrusion into the cowl 20, which could damage the engine 14 and/or short electrical connections made thereto. Many of the above-incorporated patents describe such adapters and grommets, but fail to provide a solution to at least two problems realized by the inventors of the present disclosure. Namely, through research and development, the present inventors have discovered that hand access through this small opening 34 is very difficult. Current systems require either that a plurality of vessel-sourced lines 40 be brought through the opening 34 and connected to the engine 14, or provide very short engine-sourced lines that extend from the engine 14 just enough that they can be connected to the vessel-sourced lines 40 and the connections can be hidden under the cowl 20. Both of these processes are time-consuming, especially as more functions are provided on engines and more communicative connections are required to facilitate those functions. The present inventors have developed a rigging system that does not require a person who installs an outboard motor on a transom to work within the constrained space of the small opening 34.

Additionally, the present inventors have realized through testing that noise generated by the engine 14 can be heard not only through the cowl 20, but even more so through the opening 34, especially in the case that the adapter or grommet is somewhat loose with respect to the opening 34 or with respect to the plurality of engine-sourced lines 32 that it surrounds. Thus, the present inventors have developed a rigging system where the connection between the adapter that covers the opening 34 and the surface of the cowl 20 is semi-permanent. Providing a semi-permanent adapter at this location, which acts as both a water-tight and sound-damping seal between the surface of the cowl 20 and the plurality of engine-sourced lines 32, means that the plurality of engine-sourced lines 32 may be configured to extend continuously to the marine vessel 44 and there to terminate at a plurality of distal ends 38. This is in contrast to current rigging systems, for example in which engine-sourced lines are long enough to reach just near the surface of the cowl 20, where they are there connected to lines that originate on the marine vessel 44 as described above. In the present system, connections between the plurality of engine-sourced lines 32 and the plurality of vessel-sourced lines 40 can be made aboard the marine vessel 44, rather than near the outboard motor 10. Further details of such a rigging system 42 will be described herein below.

Turning again to FIG. 6, a schematic view of a marine vessel 44 will be used to describe the rigging system 42, including a rigging center 46. The marine vessel 44 shown herein includes two outboard motors, each of which is equipped with an engine 14*a*, 14*b*. For example, the engines could be port and starboard engines. More than two outboard motors and associated engines could alternatively be provided. A plurality of engine-sourced lines 32*a* extends from the engine 14*a* of one of the outboard motors, through an aperture in a motor housing (FIG. 2), and to the marine vessel 44. The rigging center 46 is configured to be located aboard the marine vessel 44. The rigging center 46 holds a respective distal end 38*a* of each engine-sourced line in the plurality of engine-sourced lines 32. A plurality of connectors 48 is provided on the respective distal ends 38*a* of the plurality of engine-sourced lines 32*a*. At the rigging center 46, each engine-sourced line in the plurality of engine-sourced lines 32*a* is configured to be coupled, via a respective connector 48*a-c* in the plurality of connectors 48 to a corresponding vessel-sourced line 40*a-c*. The vessel-sourced line 40*a-c* is in turn connected to a respective engine-related device aboard the marine vessel 44. For example, vessel-sourced line 40*a* is connected to a helm 50 of the marine vessel 44. At the helm 50, an operator of the marine vessel 44 can input commands regarding throttle, shift, and steering for the engine 14*a* and its associated outboard motor. The vessel-sourced line 40*b* is connected to a fuel tank 52, which provides fuel to the engine 14*a*. The vessel-sourced line 40*c* is connected to a battery 54, which may for example provide starting power for the engine 14*a* and/or power to an alternator of the engine 14*a*.

The rigging system 42 further includes a second plurality of engine-sourced lines 32*b* extending from an engine 14*b* of a second outboard motor, through an aperture in a second motor housing (see FIG. 2), and to the marine vessel 44. A second plurality of connectors 49 are provided on a respective distal end 38*b* of each of the engine-sourced lines in the second plurality of engine-sourced lines 32*b*. The rigging center 46 is configured to hold the respective distal ends 38*b* of the second plurality of engine-sourced lines 32*b*. At the rigging center 46, each engine-sourced line in the second plurality of engine-sourced lines 32*b* is configured to be coupled, via a respective connector 49*a-c* in the second plurality of connectors 49, to a corresponding second vessel-sourced line that is in turn connected to the respective on-board device. For example, vessel-sourced line 40*d* connects the engine 14*b* to the fuel tank 52, vessel-sourced line 40*e* connects the engine 14*b* to the helm 50, and vessel-sourced line 40*f* connects the engine 14*b* to the battery 54. It should be understood that the connections shown herein are merely exemplary, and that more engine-related devices can be provided aboard the marine vessel 44 than those shown. Additionally, each vessel-sourced line 40*a*-40*e* is not limited to being associated with only one connector 48*a-c* and 49*a-c* aboard the vessel 44. For example, the vessel-sourced lines such as 40*a*, 40*e* that carry signals from microcontrollers can be combined and/or share wiring or cabling, such as if the vessel has a controller area network. One or more engine-related devices aboard the vessel could also be communicatively coupled to the engines 14*a*, 14*b* by way of one or more control modules, such as command control modules, propulsion control modules, thrust vector control modules, and/or engine control modules.

Returning to FIG. 3, more details of the ingress adapter 56 developed by the present inventors will be described. As mentioned, the ingress adapter 56 covers the opening 34 in the motor housing (cowl) 20, and is the device through which the plurality of engine-sourced lines 32 extends in order to exit the cowl 20. The ingress adapter 56 is coupled to both the first end 58 of the protective tube 28 and to the cowl 20. In one example, the ingress adapter 56 is an over-molded seal that encapsulates the plurality of engine-sourced lines 32 along a portion of their lengths. For example, the portion of their lengths is the portion that extends between the outer surface of the cowl 20 and the first end 58 of the protective tube 28. The ingress adapter 56 may be over-molded around the plurality of engine-sourced lines 32 using rubber, so as to provide good reduction of noise, vibration, and harshness (NVH) at the opening 34 in the cowl 20. Because the ingress adapter 56 is over-molded around the plurality of engine-sourced lines 32, the components are more or less permanently connected to one another.

The ingress adapter 56 can also be over-molded to the first end 58 of the protective tube 28, or the two components can be adhered to one another. Alternatively, the outer surface of the protective tube 28 can be threaded and the inner surface of the ingress adapter 56 can be correspondingly threaded so as to provide a threaded connection between the two components. In any case, the connection between the ingress adapter 56 and the first end 58 of the protective tube 28 can be made semi-permanent. A semi-permanent connection here is feasible because a person who installs the outboard motor 10 on the transom 12 does not need access to this area for installation; rather, connections to the plurality of vessel-sourced lines 40 are made aboard the vessel 44. The ingress adapter 56 can be coupled to the cowl 20 by way of several fasteners, two of which are shown at 62. These fasteners can be bolts, screws, or the like. The heads of the fasteners 62 can be provided on an inner surface of the cowl 20, such that they are difficult to access by the person installing the outboard motor 10 on the marine vessel 44 and he or she is not tempted to de-couple the parts and compromise the water-tight and sound-damping seal. Alternatively, the ingress adapter 56 could be adhered or permanently molded to the outer surface of the cowl 20. The ingress adapter 56 can have different sizes and shapes, and can be designed to fit over any size or shape of aperture or opening 34 in the cowl 20.

Figure 4:
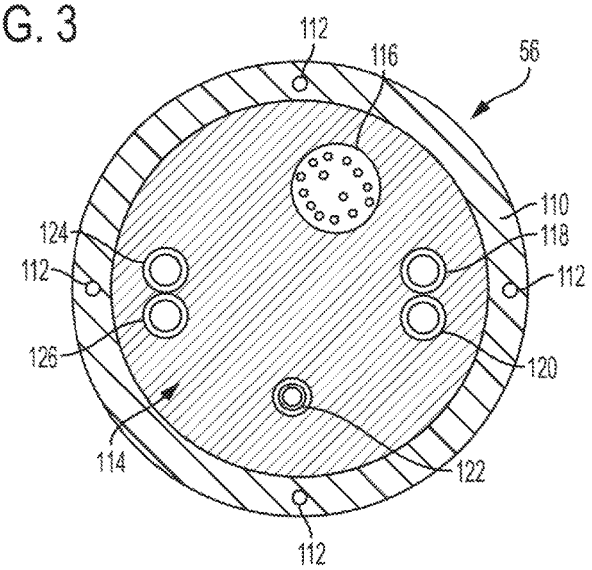
FIG. 4 illustrates an end view of a portion of the rigging system.

Now turning to FIG. 4, a cross-sectional view of the ingress adapter 56 will be shown. The ingress adapter 56 can include a flange 110 through which a number of holes 112 are provided. The fasteners 62 are inserted through these holes 112 in order to couple the ingress adapter 56 to the cowl 20. As noted, because the ingress adapter 56 can be an over-molded rubber seal that encapsulates the plurality of engine-sourced lines 32, a rubber material 114 can fill an entire interior of the adapter 56. The engine-sourced lines extend through the rubber material 114 of the adapter 56, and may include, but are not limited to, a 14-pin cable as shown at 116, shift and throttle cables 118, 120, a fuel line 122, positive and negative battery cables 124, 126, and various other lines and/or cables for communication between the vessel 44 and the engine 14. The number and type of lines provided is not limiting of the scope of the present disclosure; rather, this cross-sectional view is provided to show the tight fit that the over-molded rubber material 114 provides around the plurality of lines. This tight fit and the rubber material 114 of the adapter 56 result in both a water-tight seal and a seal that reduces the NVH of the engine 14. For instance, the overall decibel level can be reduced and the overall sound quality can be enhanced by closing the opening 34 with the abovementioned rubber material 114.

Because the ingress adapter 56, the plurality of engine sourced lines 32, and the protective tube 28 are semi-permanently connected to one another, another location must be provided for coupling the engine-sourced lines 32 to the vessel-sourced lines 40 when installing the outboard motor 10 on the transom 12. The present inventors have discovered that such connections are most conveniently made aboard the marine vessel 44, such as at the rigging center 46 (FIG. 6).

At the rigging center 46, each of the engine-sourced lines 32 and vessel-sourced lines 40 meet and are connected by the connectors 48, 49. In one example, the rigging center 46 can be built as part of (or directly into) the transom 12, 30. In another example, the rigging center 46 can be provided with a housing or cover plate, as shown at 64 in FIG. 1. The rigging center housing 64 can protect and contain the respective distal ends 38 of the plurality of engine-sourced lines 32 and the plurality of connectors 48, 49. As shown in FIG. 1, the housing or cover plate 64 can be configured to be coupled to the transom 12 of the marine vessel 44. This provides a location that is easy to access when installing the outboard motor 10 on the transom 12 of the marine vessel 44. In the example shown, the rigging center 46 and housing 64 are provided on a first side 66 of the transom 30. In order to allow easy access for the person installing the outboard motor 10, the first side 66 may be the side that faces into the vessel 44. The protective tube 28 may be coupled to the transom 30 on its second, opposite side 68. This allows the protective tube 28 to be coupled to the transom 30 without having to be bent unnecessarily.

Figure 3:
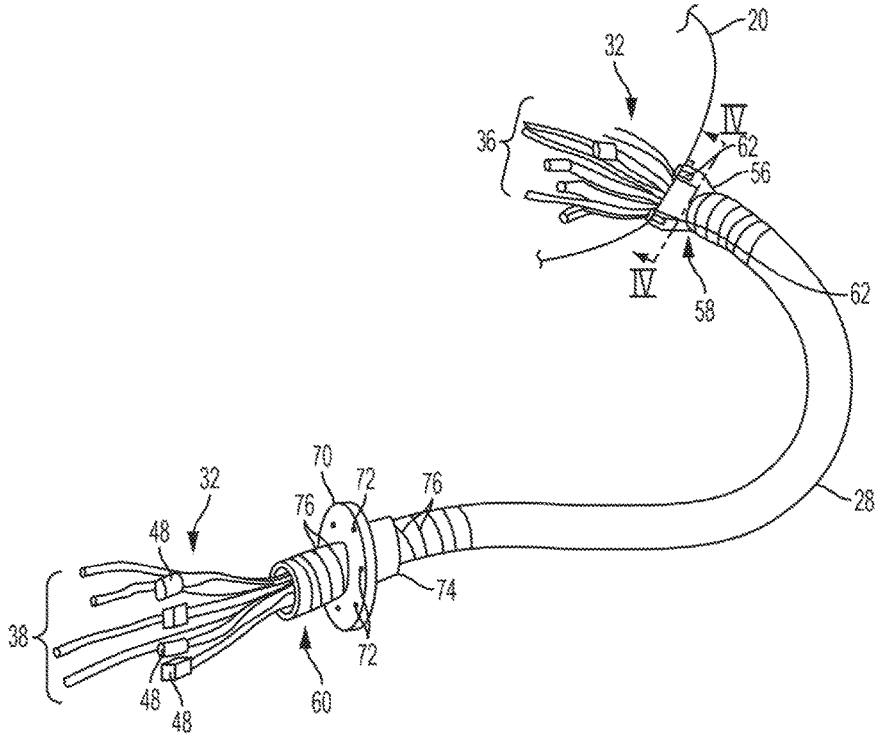
FIG. 3 illustrates a portion of the rigging system, namely a plurality of engine-sourced lines and a protective tube.

Referring to each of FIGS. 1-3, the protective tube 28 can be provided with an adjustable mounting flange 70 that encircles the protective tube 28 proximate its second end 60. The mounting flange 70 is configured to couple the protective tube 28 to the transom 30 opposite the rigging center housing 64. Specifically, the mounting flange 70 can have a plurality of openings 72 extending there through, which openings receive a plurality of threaded fasteners that extend through the mounting flange 70 and into the structure of the transom 30. By coupling the protective tube 28 to the transom 30 by way of mounting flange 70 on an opposite side 68 of the transom 30 from the rigging center housing 64, an easy pathway is made for the plurality of engine-sourced lines 32 to enter the rigging center 46 via a hole 108 provided through the transom 30.

Referring now to FIG. 3, the mounting flange 70 can be adjusted in the following manner. The mounting flange 70 may be provided with a cylindrical neck 74 that encircles and closely fits around an outer surface of the protective tube 28. An inner circumference of the neck 74 of the mounting flange 70 can be provided with threads that match threads 76 provided on an outer surface of the protective tube 28. The threads 76 can be provided only at the second end 60 of the tube 28, or could be provided along the entire length of the tube 28. Due to the threaded engagement between the outer surface of the protective tube 28 and the inner circumference of the mounting flange 70, specifically at neck 74, a distance between the mounting flange 70 and the second end 60 of the protective tube 28 can be adjusted by rotation of the mounting flange 70 with respect to the protective tube 28. As the mounting flange 70 is rotated in one direction, it can be moved closer to the second end 60 of the protective tube 28, and as it is rotated in an opposite direction, it can be moved further from the second end 60 of the protective tube 28. In this way, the length of the protective tube 28 between the outboard motor 10 and the transom 30 can also be adjusted, allowing the installer of the outboard motor 10 to provide a desired amount of slack in the lines 32 and tube 28. The remainder of the lines and tube that is on the distal side of the mounting flange 70 can be tucked down under the gunnel 78 (FIG. 1) of the vessel.

The distal ends 38 of the engine-sourced lines 32 can then enter the rigging center housing 64 by way of the hole 108 made through the transom 30, which extends from the side 68 to the side 66 of the transom 30 and into the housing 64. Although only one protective tube 28 is shown herein, it should be noted that the second plurality of engine-sourced lines **32*b* described herein above with respect to FIG. 6 can be provided with a second protective tube that surrounds the second plurality of engine-sourced lines 32*b* and has a first end coupled to the second outboard motor housing and a second end coupled to the marine vessel 44. The second protective tube could also be coupled to the rear side 68 of the transom 30 opposite the rigging center housing 64, and the second plurality of engine-sourced lines 32*b* could enter the rigging center housing in the same way as does the first plurality of engine-sourced lines 32*a***.

Figure 5:
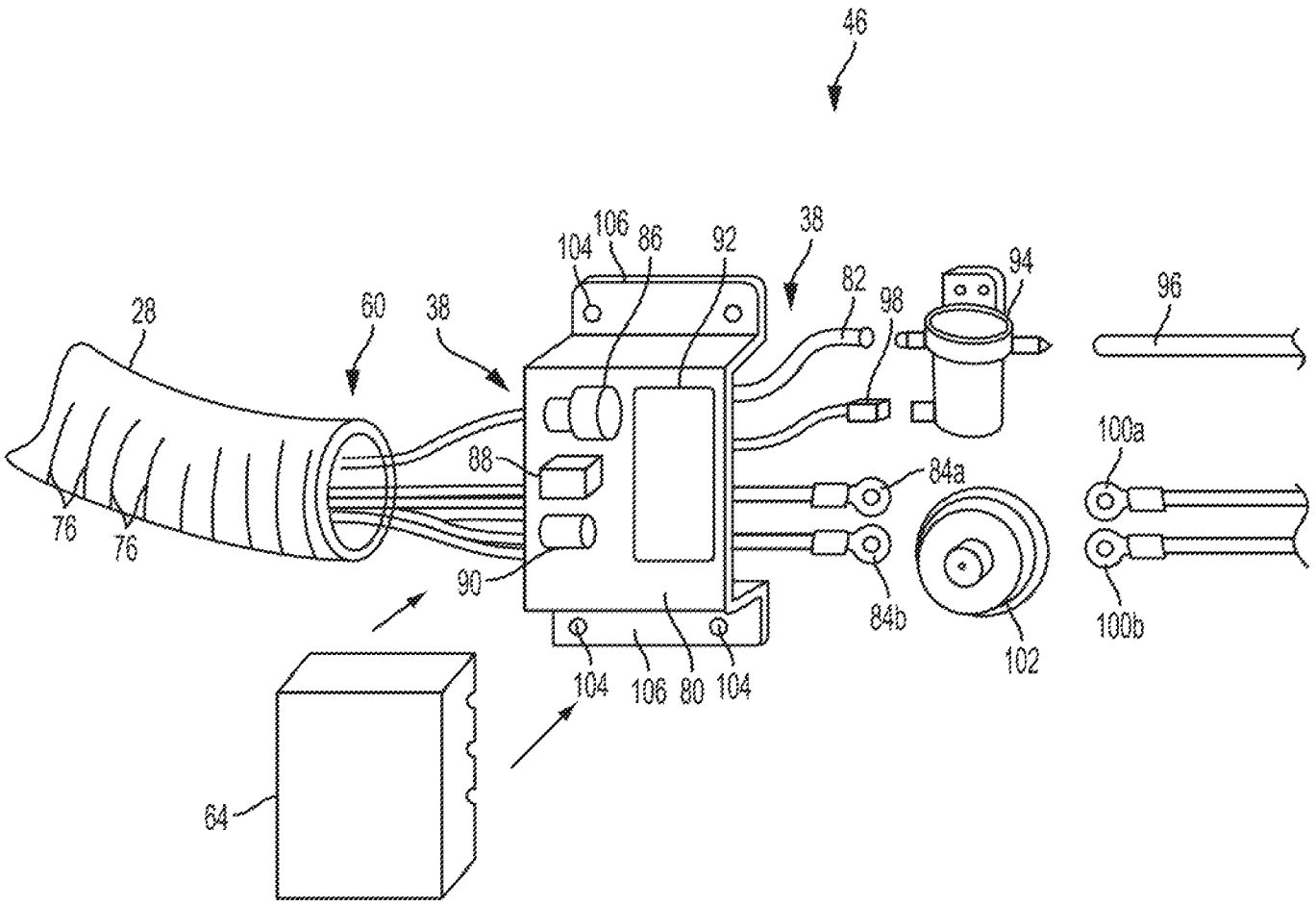
FIG. 5 illustrates one example of a housing for a rigging center according to the present disclosure.

Now turning to FIG. 5, further details of the rigging center 46 will be described. As noted above, the rigging center 46 can include a cover plate or housing 64. The housing 64 protects the plurality of connecters 48 located within the housing 64 from elements such as wind, water, and rain, as well as from accidental disconnection of the engine-sourced and vessel-sourced lines by a person aboard the marine vessel. The rigging center 46 may further include a partition 80, such as another cover plate, within the rigging center housing 64. This partition 80 is configured to separate some of the connectors 48 from a remainder of the connectors 48. For example, as shown herein, the partition 80 separates a fuel connector 82 and battery connectors **84*a*, 84*b* from a remainder of a plurality of connectors 48. The remainder of the plurality of connectors 48 could include, for example, a 14-pin connector 86, a sensor connector 88 (which could be connected to any number of sensors or gauges aboard the marine vessel 44, such as a tachometer, a speedometer, a steering position sensor, a throttle position sensor, a transmission position sensor, or the like), and a clean power connecter 90. Of course, the connectors described herein are merely exemplary, and fewer or more connectors could be provided depending on the capabilities of the outboard motor 10 and functions with which it is provided. The partition 80 could include labels or a plate 92 that indicates where each connector in the rigging center 46 should be located. Although not shown herein, each of the distal ends 38 of the plurality of engine-sourced lines 32 could be held to the partition 80** by a mechanical hold down.

Although the partition 80 need not be provided, in some instances having the partition 80 might be desirable, such as in the case where fuel and battery lines are already provided aboard the marine vessel 44. Generally, fuel systems and batteries are installed in a boat by the original manufacturer, while other types of control systems, providing unique functionalities to the outboard motor 10, may not be pre-installed. Behind the partition 80, a fuel filter 94 can be pre-connected to a vessel-sourced fuel-in line connector 96. The noted engine-sourced fuel-out line connector 82 can be connected to an opposite side of the fuel filter 94. A water-in-fuel connector 98 can also be connected to the fuel filter 94. Meanwhile, positive and negative leads coming from the battery 54 (see FIG. 6) can be connected to an on/off switch 102, the other side of which is connected to the noted engine-sourced connectors 84*a*, 84*b*. The fuel filter 94 and on/off switch 102 can be provided anywhere inside the rigging center housing 64, behind the partition 80, or elsewhere aboard the marine vessel 44, such as under the gunnel 78.

To install the rigging system 42, if the fuel and battery systems are already present on the marine vessel 44, the partition 80 can be placed over these connectors by way of fasteners threaded through holes 104 in a flange 106 on upper and lower sides of the partition 80. The other vessel-sourced lines 40 can be snaked through the marine vessel 44, as known to those having ordinary skill in the art, and brought to the rigging center 46 as well. Thereafter, once the outboard motor 10 is installed on the transom 12, the protective tube 28 can be brought proximate the transom 30, and the engine-sourced lines 32 can be snaked through the hole (108, FIG. 1) provided therein. The distal ends 38 of the plurality of engine-sourced lines 32 can thereafter be inserted into the rigging center 46, and there connected to corresponding ends of the vessel-sourced lines 40. The cover plate or housing 64 can then be attached, such as by a friction fit or by additional fasteners, over the connectors 48 and the ends of the lines 32, 40. The mounting flange 70 can be rotated to fit against the rear side 68 of the transom 30 and any extra length of the tube 28 that is not needed for slack between the outboard motor 10 and the transom 30 can be pushed through the hole 108 and hidden under the gunnel 78.

The rigging system 42 of the present disclosure therefore provides several advantages over prior art systems and methods, which required a person installing the outboard motor to pull the engine-sourced cables out of the cowl or push the vessel-sourced cables into the cowl by way of the small opening, pull the cables through several holes in a rubber grommet, and clamp around the grommet to provide a connection to the engine cowl. However, because connections in the present system are not made underneath the cowl, the under-cowl environment can be designed much cleaner, which provides increased reliability of the engine and the connections made thereto, as well as a consumer perception of good craftsmanship. As engines have become greater in horsepower, larger, and therefore packaged tighter, the space between the cowl 20 and the engine 14 has decreased, while the number of connections provided to the engine 14 has increased due to increased outboard functionality. This also increases the need for cleaner under-cowl environments. Additionally, because the rigging system 42 of the present disclosure does not require an installer to have access to the cables under the cowl 20, the semi-permanent over-molded ingress adapter 56 is able to provide excellent NVH to the system overall. As NVH quality of marine products becomes more and more important, this quality has become increasingly attractive.

It should be noted that at the rigging center 46, the connections and connectors 48 provided therein can be designed to be unique to each type of outboard motor, or a different type of rigging center 46 can be designed for different outboard families. Additionally, the rigging center 46 need not be provided at the transom (whether such location be on the true transom 12 or the false transom 30), but could instead be provided on the gunnel 78, at the helm 50, or anywhere else aboard the marine vessel 44 that provides increased accessibility over existing systems requiring connections to be made at the outboard motor 10.

The above-described rigging system simplifies the boat rigging process, saves under-cowl space by moving bulky components from under the cowl 20 to the boat transom area, and reduces noise levels by improving the cowl seal characteristics around the protective tube 28. Improved reliability can also be provided because a strain relief point between the cables and connectors is included by making connections aboard the vessel 44. Additionally, a potential under-cowl water intrusion point is eliminated because the ingress adapter 56 and the cowl 20 are semi-permanently connected to one another. By providing connections exterior to the under-cowl environment, the occurrence of connectors not being fully mated is also minimized, as it is easier to provide full mating and proper torque to the connectors 48 when they are more easily accessible, such as at a rigging center 46 aboard the marine vessel 44.

In the above description, certain terms have been used for brevity, clarity, and understanding. No unnecessary limitations are to be inferred therefrom beyond the requirement of the prior art because such terms are used for descriptive purposes and are intended to be broadly construed. The different systems described herein may be used alone or in combination with other systems. It is to be expected that various equivalents, alternatives and modifications are possible within the scope of the appended claims.

What is claimed is:

1. A rigging system for coupling an outboard motor to a transom of a marine vessel, the rigging system comprising:

a plurality of engine-sourced lines having respective proximate ends directly connected to an engine of the outboard motor and extending continuously from the engine, through an aperture in a motor housing, and to the marine vessel;

an ingress adapter that covers the aperture in the motor housing and through which the plurality of engine-sourced lines extends;

a protective tube surrounding the plurality of engine-sourced lines and having a first end coupled to the motor housing by way of the ingress adapter and a second end coupled to the marine vessel;

a rigging center configured to be located aboard the marine vessel that holds a respective distal end of each engine-sourced line in the plurality of engine-sourced lines; and a plurality of connectors provided on the respective distal ends of the plurality of engine-sourced lines;

wherein at the rigging center, each engine-sourced line in the plurality of engine-sourced lines is configured to be coupled, via a respective connector in the plurality of connectors, to a corresponding vessel-sourced line that is in turn connected to a respective engine-related device aboard the marine vessel; and wherein the plurality of engine-sourced lines, the ingress adapter, and the protective tube are semi-permanently connected to one another.

2. The rigging system of claim 1, wherein the ingress adapter is an over-molded seal that encapsulates the plurality of engine-sourced lines along a portion of their lengths.

3. The rigging system of claim 1, further comprising a rigging center housing that contains the respective distal ends of the plurality of engine-sourced lines and the plurality of connectors.

4. The rigging system of claim 3, further comprising a partition within the rigging center housing that is configured to separate a fuel connector and a battery connector from a remainder of the plurality of connectors.

5. The rigging system of claim 3, wherein the rigging center housing is configured to be coupled to the transom of the marine vessel.

6. The rigging system of claim 5, further comprising an adjustable mounting flange encircling the protective tube proximate the second end of the protective tube, the mounting flange being configured to couple the protective tube to the transom opposite the rigging center housing.

7. The rigging system of claim 6, wherein an outer surface of the protective tube and an inner circumference of the mounting flange are threadedly engaged with one another, thereby allowing a distance between the mounting flange and the second end of the protective tube to be adjusted by rotation of the mounting flange with respect to the protective tube.

8. The rigging system of claim 1, further comprising:

a second plurality of engine-sourced lines extending from an engine of a second outboard motor, through an aperture in a second motor housing, and to the marine vessel;

a second protective tube surrounding the second plurality of engine-sourced lines and having a first end coupled to the second motor housing and a second end coupled to the marine vessel; and a second plurality of connectors provided on respective distal ends of the second plurality of engine-sourced lines;

wherein the rigging center is configured to hold the respective distal ends of the second plurality of engine-sourced lines; and wherein at the rigging center, each engine-sourced line in the second plurality of engine-sourced lines is configured to be coupled, via a respective connector in the second plurality of connectors, to a corresponding second vessel-sourced line that is in turn connected to the respective engine-related device aboard the marine vessel.

9. An outboard motor for coupling to a transom of a marine vessel, the outboard motor comprising:

an engine coupled in torque-transmitting relationship with a propulsor via a driveshaft;

a cowl that houses the engine therein;

an opening extending through a surface of the cowl;

a plurality of engine-sourced lines having proximate ends directly connected to the engine and exiting the cowl via the opening;

an ingress adapter covering the opening and providing a watertight seal between the surface of the cowl and the plurality of engine-sourced lines; and a protective tube surrounding the plurality of engine-sourced lines and having a first end coupled to the cowl by way of the ingress adapter and a second end coupled to the marine vessel;

wherein the plurality of engine-sourced lines is configured to extend continuously from the engine to the marine vessel and there to terminate at a plurality of distal ends of the engine-sourced lines;

wherein aboard the marine vessel, each distal end in the plurality of distal ends of the engine-sourced lines is configured to couple to a respective vessel-sourced line that is in turn connected to a respective engine-related device aboard the marine vessel; and wherein the plurality of engine-sourced lines, the ingress adapter, and the protective tube are semi-permanently connected to one another.

10. The outboard motor of claim 9, wherein the ingress adapter is an over-molded seal that encapsulates the plurality of engine-sourced lines along a portion of their lengths.

11. The outboard motor of claim 10, wherein the plurality of distal ends of the engine-sourced lines is configured to be held at a rigging center located aboard the marine vessel.

12. The outboard motor of claim 11, further comprising a plurality of connectors respectively provided on the plurality of distal ends of the engine-sourced lines.

13. The outboard motor of claim 12, wherein the rigging center includes a cover plate that protects the plurality of distal ends of the engine-sourced lines and the plurality of connectors.

14. The outboard motor of claim 12, wherein the rigging center cover plate is configured to be coupled to the transom of the marine vessel.

15. The outboard motor of claim 14, wherein the second end of the protective tube is coupled to the transom opposite the rigging center cover plate.

16. The outboard motor of claim 15, further comprising an adjustable mounting flange encircling the protective tube proximate the second end of the protective tube, the mounting flange being configured to couple the protective tube to the transom.

* * * * *